US005538826A

United States Patent [19]

Ainoya et al.

[11] Patent Number: 5,538,826

[45] Date of Patent: Jul. 23, 1996

[54] ELECTROPHOTOGRAPHIC IMAGE FORMING METHOD, APPARATUS AND DEVICE UNIT

[75] Inventors: Hideyuki Ainoya, Tokyo; Toshiyuki Yoshihara, Kawasaki; Hideki Anayama; Itaru Yamazaki, both of Yokohama; Hidetoshi Hirano, Tokyo; Mayumi Kimura, Kawasaki, all of Japan

[73] Assignee: Canon Kabushiki Kaisha, Tokyo, Japan

[21] Appl. No.: 301,596

[22] Filed: Sep. 7, 1994

[30] Foreign Application Priority Data

Sep. 9, 1993 [JP] Japan ..... 5-247347

[51] Int. Cl.[6] ..... G03G 5/04

[52] U.S. Cl. ..... 430/58; 430/67; 430/902; 355/219

[58] Field of Search ..... 430/58, 66, 67, 430/96, 902; 355/219

[56] References Cited

U.S. PATENT DOCUMENTS

| | | | |
|---|---|---|---|
| 4,727,453 | 2/1988 | Ewing | 361/225 |
| 4,851,314 | 7/1989 | Yoshinara | 430/59 |
| 5,068,762 | 11/1991 | Yoshinara | 361/225 |
| 5,235,386 | 8/1993 | Yano et al. | 355/219 |
| 5,246,807 | 9/1993 | Kanemaru et al. | 430/58 |
| 5,254,423 | 10/1993 | Mayama et al. | 430/58 |
| 5,283,142 | 2/1994 | Mayama et al. | 430/96 |

FOREIGN PATENT DOCUMENTS

| | | |
|---|---|---|
| 0538070 | 4/1993 | European Pat. Off. . |
| 0586965 | 3/1994 | European Pat. Off. . |
| 178267 | 11/1982 | Japan . |
| 40566 | 3/1983 | Japan . |
| 149668 | 6/1988 | Japan . |

OTHER PUBLICATIONS

Pat. Abst. of Japan, vol. 12, No. 276 (P–737) Jul. 1988 based on JP–63–056658.

Pat. Abst. of Japan, vol. 15, No. 136 (P–1187) Apr. 1991 based on JP–3–015075.

Pat. Abst. of Japan, vol. 15, No. 309 (P–1235) Aug. 1991 based on JP–3–110589.

*Primary Examiner*—John Goodrow

*Attorney, Agent, or Firm*—Fitzpatrick, Cella, Harper & Scinto

[57] ABSTRACT

An electrophotographic photosensitive member having a surface layer comprising a bisphenol Z-type polycarbonate resin is charged by contact charging. The charged electrophotographic photosensitive member is then subjected to imagewise exposure to form an electrostatic latent image on the photosensitive member, the thus formed electrostatic latent image on the electrophotographic photosensitive member is developed. The electrophotographic photosensitive member shows good resistance to wearing and toner sticking when subjected to electrophotographic image formation including a contact charging process.

13 Claims, 2 Drawing Sheets

ELECTROPHOTOGRAPHIC IMAGE FORMING METHOD, APPARATUS AND DEVICE UNIT

FIELD OF THE INVENTION AND RELATED ART

The present invention relates to an electrophotographic image forming method, an electrophotographic apparatus and an electrophotographic device unit, respectively, using contact charging.

In an electrophotographic process including steps of charging, exposure, development, transfer and cleaning applied to an electrophotographic photosensitive member, and a step of fixation to images, it has been an ordinary practice to effect charging with corona generated by applying a high voltage of 5–8 kilo-volts DC.

In view of ozone and/or NOx generated at the time of corona discharge, a contact charging process free from generation of such gases has been proposed (Japanese Patent Laid-Open Application (JP-A) 57-178267, JP-A 58-40566, etc.). In the contact charging process, an electrophotographic photosensitive member is charged by a charging member in contact with the photosensitive member, and the charging member is generally supplied with a DC voltage superposed with an AC voltage (JP-A 63-149668).

In the contact charging process, the charging member is in direct contact with an electrophotographic photosensitive member, an excellent durability is required of the electrophotographic photosensitive member. Particularly, in case where an AC voltage is applied to the charging member, the electrophotographic photosensitive member is liable to suffer from noticeable surface deterioration, such as occurrence of pinholes.

The surface deterioration of the electrophotographic photosensitive member is liable to lead to difficulties, such as toner sticking onto the surface or abnormal abrasion of the surface.

SUMMARY OF THE INVENTION

An object of the present invention is to provide an electrophotographic image forming method including the use of a photosensitive member capable of showing excellent abrasion resistance, causing little toner sticking and supplying good images in combination with the contact charging process.

A further object of the present invention is to provide an electrophotographic apparatus and an electrophotographic device unit suitable for application to such an image forming method.

According to the present invention, there is provided an electrophotographic image forming method, comprising:

- a contact charging step for charging an electrophotographic photosensitive member having a surface layer comprising a bisphenol Z-type polycarbonate resin by contact charging,
- an imagewise exposure step for subjecting the charged electrophotographic photosensitive member to imagewise exposure to form an electrostatic latent image on the photosensitive member, and
- a development step for developing the electrostatic latent image on the electrophotographic photosensitive member.

According to another aspect of the present invention, there is provided an electrophotographic apparatus, comprising:

- an electrophotographic photosensitive member having a surface layer comprising a bisphenol Z-type polycarbonate resin,
- a charging member for charging the electrophotographic photosensitive member in contact with the electrophotographic photosensitive member,
- imagewise exposure means for imagewise exposing the charged electrophotographic photosensitive member to form an electrostatic latent image thereon, and
- developing means for developing the electrostatic latent image on the electrophotographic photosensitive member.

According to a further aspect of the present invention, there is provided an electrophotographic device unit, comprising:

- an electrophotographic photosensitive member having a surface layer comprising a bisphenol Z-type polycarbonate resin, and
- a charging member for charging the electrophotographic photosensitive member in contact with the photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In the electrophotographic image forming method according to the present invention, an electrophotographic photosensitive member having a surface layer comprising a bisphenol Z-type polycarbonate resin (in a sense of including derivatives having benzene rings capable of having a substituent) is used and charged by a charging member disposed in contact with the photosensitive member and supplied with a voltage (this process being referred to herein as "contact charging (process)").

The surface layer of an electrophotographic photosensitive member refers to a photosensitive layer when the photosensitive member has a single photosensitive layer, a layer in the photosensitive layer remotest from an electroconductive support when the photosensitive layer is a laminated-type one, and a protective layer when the photosensitive layer has such a protective layer on the photosensitive layer.

Figure 1:
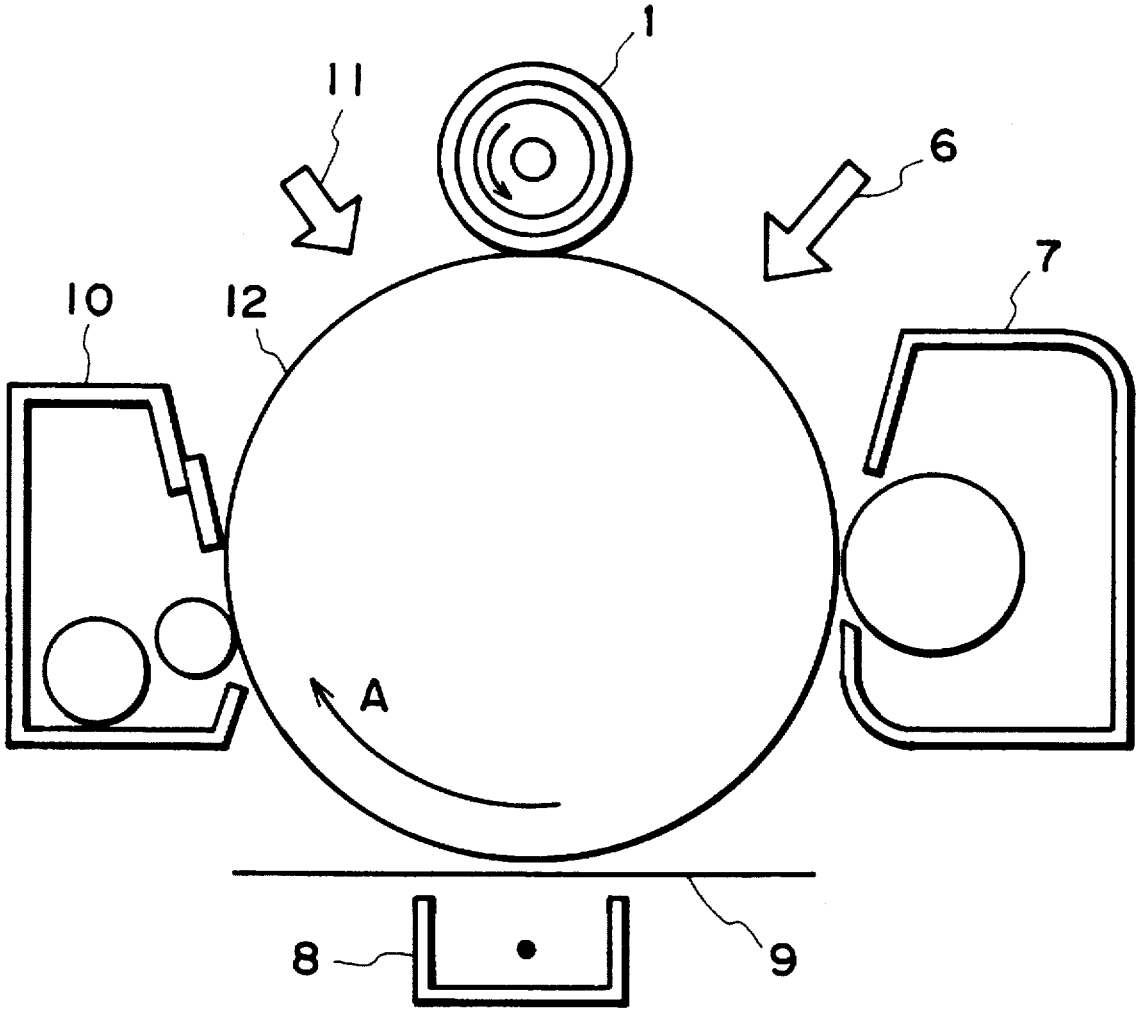
FIGS. 1 through 3 are respectively an illustration of an embodiment of the electrophotographic apparatus according to the present invention.

FIG. 1 shows an embodiment of the image forming apparatus according to the invention. Referring to FIG. 1, a charging member 1 is disposed to contact the outer peripheral surface of an electrophotographic photosensitive member 12 in the form of a drum rotating in the direction of an arrow A to charge the photosensitive member to a prescribed voltage of a positive or negative polarity. The charging member 1 may be supplied with a positive or negative DC voltage which may preferably be in the range of −2000 volts to +2000 volts. It is possible to superpose an AC voltage with the above-mentioned DC voltage. The AC voltage superposed with the DC voltage may preferably have a peak-to-peak voltage of at most 4000 volts. The AC voltage can also have such an amplitude so as to provide pulse voltages in superposition with the DC voltage. The superposition of an AC voltage can, however, cause an abnormal sound due to vibration of the charging member and the photosensitive member in some cases.

The charging member 1 can be instantaneously supplied with a prescribed voltage or can be supplied with a gradually increasing voltage so as to protect the photosensitive member.

The charging member 1 may be rotated in a direction identical to that of the photosensitive member 12 as shown in FIG. 1, or may be rotated in a reverse direction or disposed un-rotated so as to rub the outer surface of the photosensitive member. Further, the charging member 1 can be provided with a function of cleaning residual toner on the photosensitive member 12 so as to omit a cleaning means 10.

The charged photosensitive member is then illuminated with image light 6 from an imagewise exposure means (not shown), such as slit exposure means or laser beam scanning exposure means. As a result, an electrostatic latent image corresponding to the image light is sequentially formed on the periphery of the photosensitive member 12. The latent image is then developed with a toner by a developing means 7, and the resultant toner developed image is sequentially transferred by a transfer charging means 8 to a recording material 9 which is supplied from a paper supply (not shown) to between the photosensitive member 12 and the transfer charging means 8 in synchronism with the rotation of the photosensitive member 12. The recording material 9 having thereon a transferred image is then separated from the photosensitive member surface and supplied to an image fixing means (not shown) where the transferred image is fixed to provide a copy product, which is then discharged out of the apparatus.

The surface of the photosensitive member 12 after the transfer subjected to removal of residual toner by a cleaning means to be cleaned and then subjected to a discharge treatment by a pre-exposure means 11, followed by repetitive image formation.

Figure 2:
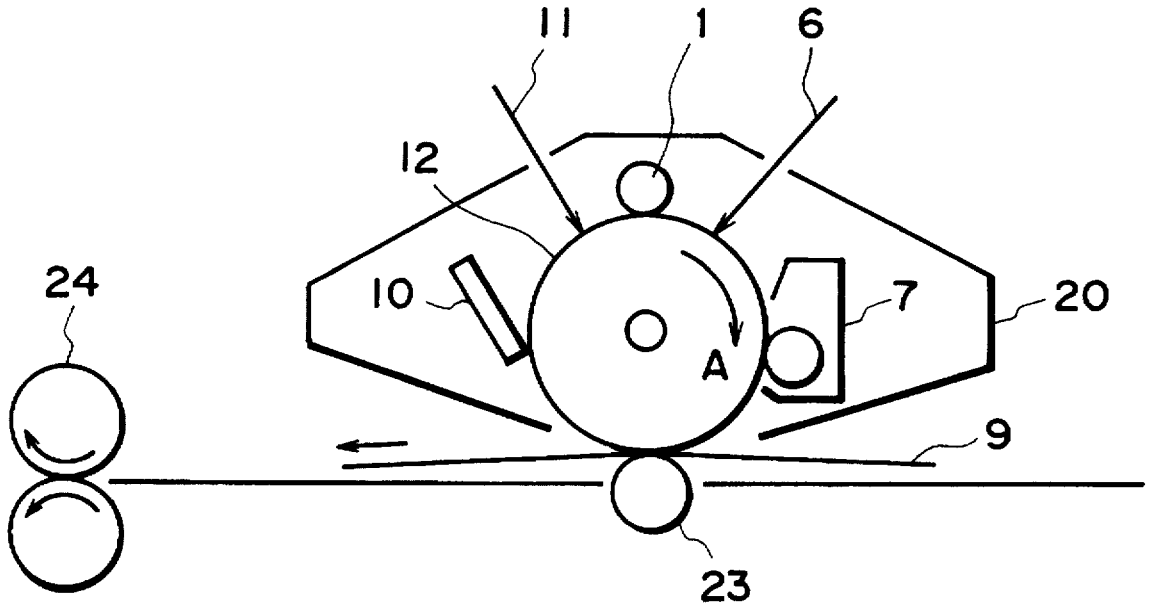
Figure 3:
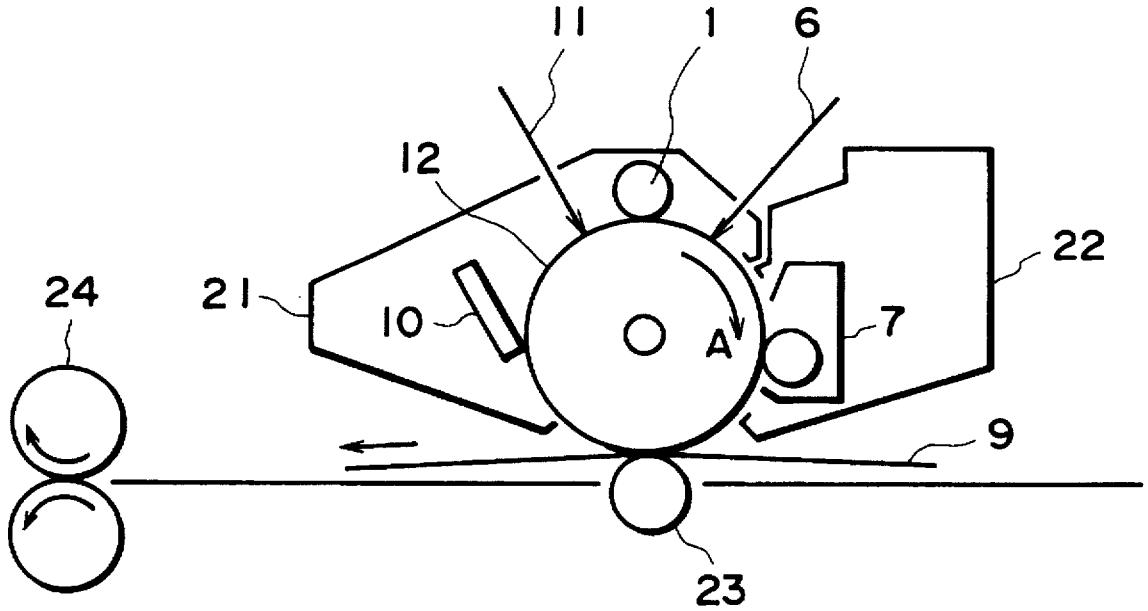

It is possible to combine a plurality among the above-mentioned components of the electrophotographic apparatus, such as the photosensitive member and the developing means, to constitute a device unit which can be detachably mountable to a main assembly of the electrophotographic apparatus. For example, an electrophotographic device unit may be constituted, as shown in FIG. 2, by disposing at least a photosensitive member 12, a charging member 1 and a developing means 12 in a casing 20, so that the device unit can be detachably mountable to (i.e., attached to or released from, as desired) the apparatus main assembly by using a guide means, such as a guide rail in the apparatus main assembly. The cleaning means 10 may be disposed in the casing 20, as shown, or disposed outside the casing 20, as desired. Further, it is also possible to dispose at least a photosensitive member 12 and a charging member 1 in a first casing 21 to form a first electrophotographic device unit, and dispose at least a developing means 7 in a second casing 22 to form a second electrophotographic device unit, so that the first and second device units can be detachably mountable to the main assembly of the electrophotographic apparatus. In the embodiments shown in FIGS. 2 and 3, a charging member 23 is used as a transfer charging means. The charging member 23 may have a structure similar to that of the charging member 1. The charging member 23 as the transfer charging means may preferably be supplied with a DC voltage of 400–2000 volts. FIGS. 2 and 3 show a fixing means 24 omitted from showing in the embodiment of FIG. 1.

The bisphenol Z-type polycarbonate resin constituting the surface layer of the electrophotographic photosensitive member 12 may preferably be one represented by the following formula (I)

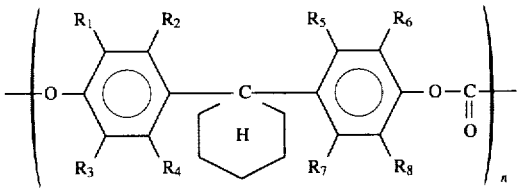

(I)

wherein $R_1$–$R_8$ independently denote hydrogen, halogen, alkyl group capable of having a substituent, alkenyl group capable of having a substituent and aryl group capable of having a substituent. The alkyl or alkenyl group as group $R_1$–$R_8$ may preferably have 1–4 carbon atoms. The aryl group (which can be a combination of a plurality of $R_1$–$R_8$) may preferably be one providing a benzene nucleus, which can be fused with a benzene nucleus in the main chain. Examples of the substituent which can be possessed by the alkyl, alkenyl or aryl group may include bromine, chlorine, fluorine, methyl, ethyl, propyl and vinyl. The bisphenol Z-type polycarbonate resin used in the present invention may preferably have a viscosity-average molecular weight of 30,000–80,000, more preferably 30,000–60,000. The bisphenol Z-type polycarbonate resin having a molecular weight in the prescribed range may provide a solution having an appropriate viscosity suitable for application or coating and provide the surface layer with optimum mechanical properties inclusive of a strength.

The weight-average molecular weight refers to a value based on measurement based on the solution viscosity method (JIS K6719).

The electrophotographic photosensitive member used in the present invention may have a so-called single layer-type photosensitive layer which comprises a charge-generating substance and a charge-transporting substance in a single layer, or a lamination-type photosensitive layer which includes in lamination a charge generation layer containing a charge-generating substance and a charge transport layer containing a charge-transporting substance. However, in order to better satisfy various properties required of an electrophotographic photosensitive member, it is preferred to use the latter photosensitive member including the lamination photosensitive layer.

Preferred examples of the charge-generating substance may include: azo pigments, quinone pigments, quinocyanine pigments, perylene pigments, indigo pigments, azulenium slat pigments, oxytitanium phthalocyanine, copper phthalocyanine, selenium-tellurium, pyrylium dyes, and thiopyrylium dyes. In case of a photosensitive layer of the lamination type, the charge generation layer may be formed by vapor-deposition, or by application of a solution of the charge-generating substance together with binder resin and a solvent prepared by dispersion or dissolution by means of a homogenizer, an ultrasonic disperser, a ball mill, a vibrating ball mill, a sand mill, attritor or a roll mill. The charge-generating substance and the binder resin may preferably be blended in a weight ratio of 1:5–5:1, more preferably 1:2–3:1. The charge generation layer may preferably be formed in a thickness of at most 5 μm, more preferably 0.05–2 μm.

The charge-transporting substance may be an electron-transporting substance or a hole-transporting substance. Examples of the electron-transporting substance may include: electron-attracting substances, such as chloroanil, tetracyanoethylene, tetracyano-quinodimethane, 2,4,5,7-tetranitro-9-fluorenone, 2,4,5,7-tetranitroxanthone, and 2,4,8-trinitrothio-xanthone; and polymerized derivatives of these electron-attracting substances.

Examples of the hole-transporting substance may include: hydrazones, such as p-pyrrolidino-benzaldehyde-N,N-diphenylhydrazone, and p-diethyl-benzaldehyde-3-methylbenzthiazoline-2-hydrazone; pyrazolines, such as 1[pyridyl(2)]-3-(p-diethyl-aminostyryl)- 4-methyl-5-(p-diethylaminophenyl)pyrazoline, 1-phenyl-3-(p-diethylaminostyryl)-4-methyl-5-(p-diethylaminophenyl)pyrazoline, and spiropyrazoline; styryl compounds, such as a-phenyl-4-N,N-diphenylaminostilbene, N-ethyl-3-(d-phenylstyryl)-carbazole, 9-dibenzylaminobenzylidene-9H-fluorenone, and 5-p-ditolylaminobenzylidene-5H-dibenzo[a,d]cyclo-heptene; thiazole compounds, such as 2-(p-diethyl-aminostyryl)-6-diethylaminobenzothiazole; triarylmethane compounds, such as bis(4-diethylamino-2-methylphenyl)phenylmethane; polyarylalkanes, such as 1,1,2,2-tetrakis (4-N,N-diethylamino-2-methylphenyl)-ethane; triphenylamine, poly-N-vinylcarbazole, polyvinylpyrene, polyvinylanthracene, polyvinylacridine, poly-p-vinylanthracene, pyrene-formaldehyde resin, and ethyl carbazole-formaldehyde resin.

In addition to the organic charge-transporting substances described above, it is also possible to use an inorganic substance, such as selenium, selenium-tellurium or cadmium sulfide.

Particularly effective examples of the charge-transporting substance may include the following:

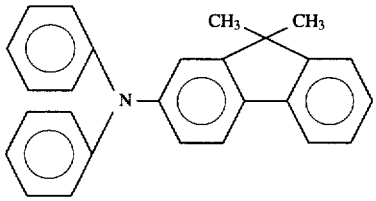

(1)

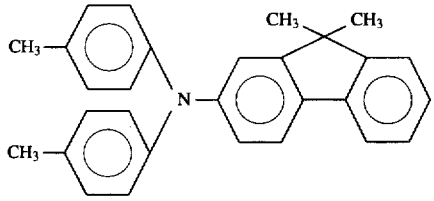

(2)

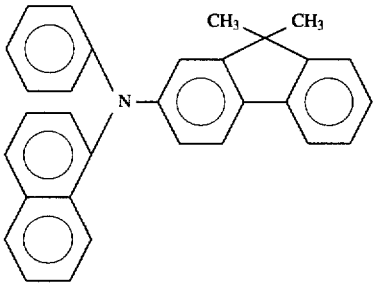

(3)

-continued

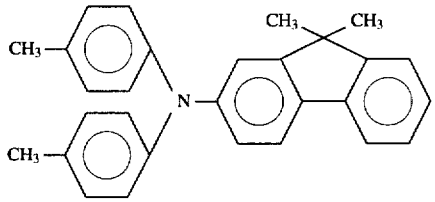

(4)

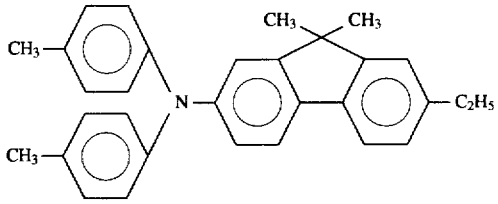

(5)

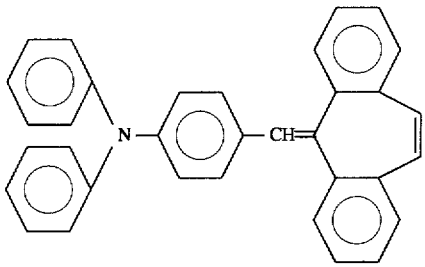

(6)

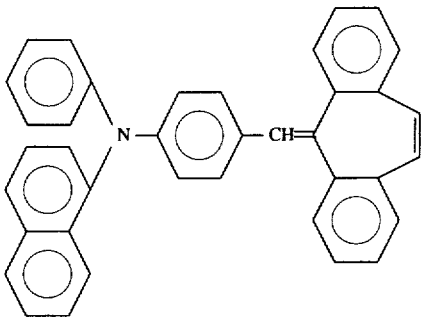

(7)

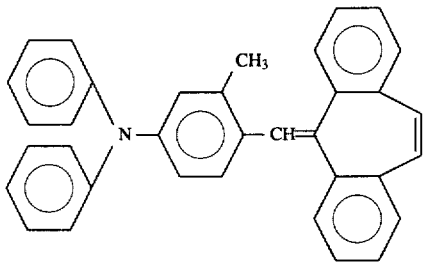

(8)

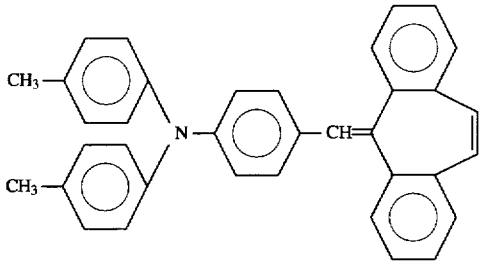

(9)

-continued (10)

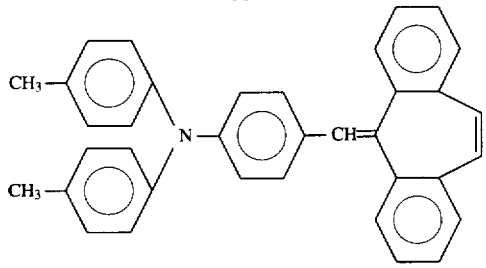

In case of a photosensitive layer of the lamination type, the charge transport layer may be formed by dissolving a charge-transporting substance as described above together with a binder resin in a solvent to form a solution, followed by application and drying of the solution. The charge-transporting substance and the binder resin may preferably be blended in a weight ratio of 3:1–1:3, further preferably 2:1–1:2. The charge transport layer may preferably be formed in a thickness of 5–40 μm, further preferably 10–30 μm.

A photosensitive layer of the single layertype may be formed by dissolving or dispersing a charge-generating substance and a charge-transporting substance as described above in a solvent to form a coating liquid, followed by application and drying of the coating liquid.

The binder resin constituting a photosensitive layer other than the surface layer or a surface photosensitive layer in combination with the bisphenol Z-type polycarbonate resin may for example comprise: polyvinyl butyral, polyvinyl benzal, polyalkylate, polycarbonate, polyester, phenoxy resin, cellulose resins, acrylic resins, polyurethane, acrylonitrile-styrene copolymer, polyacrylamide, polyamide or chlorinated rubber.

Particularly, the binder resin for the charge generation layer may preferably comprise, e.g., polyvinyl butyral, polyvinyl benzal, polyallylate, polycarbonate, polyester, phenoxy resin, cellulose resin, acrylic resin, polyurethane. The binder resin for the charge transport layer may preferably comprise, e.g., acrylic resin, polyallylate, polyester, polycarbonate, polystyrene, acrylonitrilestyrene copolymer, polyacrylamide, polyamide, or chlorinated rubber.

The electrophotographic photosensitive member used in the present invention may be provided with a protective layer, as desired, on the photosensitive layer. The protective layer may for example comprise: polyethylene polypropylene, polyvinylidene chloride, polystyrene, Poly-α-methylstyrene, polymethyl methacrylate, polycarbonate, or methyl methacrylate-styrene copolymer.

In the protective layer, it is possible to add an electroconductivity-imparting substance, such as a charge-transporting substance as descried above or electroconductive particulate in order to reduce the residual potential characteristic of the resultant photosensitive member. Examples of the electroconductive particulate may include: powder, flake and short fiber of metals, such as aluminum, copper, nickel and silver; electroconductive metal oxides, such as antimony oxide, indium oxide and tin oxide; polymeric electroconductive substances, such as polypyrrole, polyaniline or polymeric electrolytes; carbon black, carbon fiber and graphite powder.

The protective layer may preferably have a thickness of 0.2–15 μm in view of the residual potential characteristic and desired durability, particularly preferably 0.5–15 μm in view of the film strength and the image forming characteristic.

The bisphenol Z-type polycarbonate resin is used as a binder resin in the surface layer, and may preferably constitute 50–100 wt. %, particularly 70–98 wt. %, of the binder resin of the surface layer.

The photosensitive layer or protective layer may be formed by a coating method, such as dip coating, spray coating, spinner coating, curtain flow coating, roller coating or gravure coating of a coating liquid using a solvent, such as tetrahydrofuran, dioxane, cyclohexanone, benzene, toluene, xylene, monochlorobenzene, dichloromethane, dichlorobenzene or a mixture of these. For producing an electrophotographic photosensitive member in the form of a drum effectively and accurately in a large mass, the dip coating method may be the best.

The electrophotographic photosensitive member used in the present invention may have an electroconductive support, which may comprise a support structure of an electroconductive material, such as aluminum, aluminum alloy, copper, zinc, stainless steel, vanadium, molybdenum, chromium, titanium, nickel, indium, gold, or platinum. Further, it is also possible to constitute an electroconductive support as a support of plastic or paper coated with an electroconductive layer of aluminum, aluminum alloy, indium oxide, tin oxide, indium-tin-oxide, or a support of a plastic material comprising an electroconductive polymer.

It is possible to optionally dispose an undercoating layer having a barrier function and an adhesive function between the electroconductive support and the photosensitive layer. The undercoating layer may for example be formed of casein, polyvinyl alcohol, nitrocellulose, ethyleneacrylic acid copolymer, polyvinyl butyral, phenolic resin, polyamide, polyurethane, gelatin, or aluminum oxide. The undercoating layer may preferably be formed in a thickness of 0.1–10 μm, particularly 0.1–5 μm. In order to prevent the occurrence of interference fingers due to scattering in the case of laser light as a source of image light, it is sometimes effective to dispose an optional electroconductive layer on the electroconductive support, preferably below the undercoating layer. The optional electroconductive layer may be formed by dispersing electroconductive powder, such as carbon black, metal particles or metal oxide particles in an appropriate binder resin. The optional electroconductive layer may have a thickness of 5–40 μm, preferably 10–30 μm.

The contact charging member 1 may have any shape inclusive of a roller as shown in FIGS. 1–3, a brush, a blade, a belt, or a flat sheet. The roller-shaped charging member 1 may preferably have a structure comprising a bar-shaped electroconductive core member surroundingly coated sequentially with an elastic layer, an electroconductive layer, and a resistance layer.

The electroconductive core member may for example comprise a metal, such as iron, copper or stainless steel, or an electroconductive resin, such as a carbon-dispersed resin or a metal particledispersed resin.

The elastic layer is a layer which is rich in elasticity and low in hardness. The elastic layer may preferably have a thickness of at least 1.5 mm, further preferably at least 2 mm, particularly preferably 3–13 mm. The elastic layer may preferably comprise, e.g., chloroprene rubber, isoprene rubber, EPDM rubber, polyurethane rubber, epoxy rubber, or butyl rubber.

The electroconductive layer may preferably have a volume resistivity of at most $10^7$ ohm.cm, further preferably at most $10^6$ ohm.cm, particularly preferably $10^{-2}$–$10^6$ ohm.cm.

The electroconductive layer may preferably be thin so as to transmit the softness of the lower elastic layer to the upper resistance layer and may preferably have a thickness of at most 3 mm, further preferably at most 2 mm, particularly preferably 20 μm –1 mm.

The electroconductive layer may comprise, e.g., a vapor-deposited metal film, an electroconductive particle-dispersed resin, or an electroconductive resin. The vapor-deposited metal film may for example be formed by vapor deposition of a metal, such as aluminum, indium, nickel, copper or iron. The electroconductive particle-dispersed resin may for example comprise a resin, such as polyurethane, polyester, vinyl acetate-vinyl chloride copolymer or polymethyl methacrylate containing electroconductive particles of, e.g., carbon, aluminum, nickel or titanium oxide, dispersed therein. The electroconductive resin may for example comprise quaternary ammonium salt-containing polymethyl methacrylate, polyvinylaniline, polyvinylpyrrole, polydiacetylene, or polyethyleneimine.

The resistance layer is formed to have a higher resistivity than the electroconductive layer and may preferably have a volume resistivity of $10^6$–$10^{12}$ ohm.cm, particularly $10^7$–$10^{11}$ ohm.cm. The resistance layer may for example comprise a semiconductive resin or an electroconductive particledispersed insulating resin. Examples of the semiconductive resin may include ethyl cellulose, nitrocellulose, methoxymethylated nylon, ethoxymethylated nylon, copolymer nylon, polyvinylpyrrolidone, casein, and mixtures of these resins. Examples of the electroconductive particledispersed insulating resin may include: insulating resins, such as polyurethane, polyester, vinyl acetate-vinyl chloride copolymer and polymethacrylic acid containing electroconductive particles of, e.g., carbon, aluminum, indium oxide or titanium oxide, in a relatively small amount so as to control the resultant resistivity.

The resistance layer may preferably have a thickness of 1–500 μm, particularly 50–200 μm.

The flat sheet-shaped charging member may be formed by disposing an electroconductive layer and a resistance layer on an elastic layer. In this case, no electroconductive core member may be used.

The blade-shaped charging member may be formed by disposing an elastic layer and a resistance layer on a metal sheet.

The brush-shaped charging member may be formed by radially disposing electroconductive fiber so as to surround the periphery of an electroconductive core metal with an adhesive layer disposed therebetween, or by disposing electroconductive member on a surface of a metal sheet with an adhesive layer disposed therebetween.

The electroconductive fiber may preferably have a volume resistivity of at most $10^8$ ohm.cm, further preferably at most $10^6$ ohm.cm, particularly preferably $10^{-2}$–$10^6$ ohm.cm. Each filament of the electroconductive fiber may preferably be sufficiently thin so as to retain the softness and may preferably have a diameter of 1–100 μm, further preferably 5–50 μm, particularly preferably 8–30 μm. The electroconductive fiber may preferably have a length of 2–10 mm, particularly 3–8 mm.

The electroconductive fiber may for example comprise an electroconductive particle-dispersed resin or an electroconductive resin as described above. The electroconductive fiber may also comprise carbon fiber.

EXAMPLES

Hereinbelow, the present invention will be described based on Examples, wherein "parts" refer to "parts by weight".

Example 1

An Al cylinder having an outer diameter of 80 mm and a length of 360 mm was used as a support. The Al cylinder was coated with a paint having the following composition by dipping, followed by heatcuring at 140° C. for 30 min. to form a 18 μm-thick electroconductive layer.

| | |
|---|---|
| Tin oxide-coated titanium oxide powder | 10 part(s) |
| Titanium oxide powder | 10 parts |
| Phenolic resin | 10 parts |
| Silicone oil | 0.001 parts |
| Methanol/ethyl cellosolve (= 1/1) | 20 parts |

Then, the electroconductive layer was coated by dipping with a solution of 3 parts of N-methoxymethylated nylon and 3 parts of copolymer nylon in a solvent mixture of 65 parts of methanol and 30 parts of n-butanol to form a 0.5 μm-thick undercoating layer.

Separately, 4 parts of bisazo pigment of the following structural formula, 2 parts of polyvinyl butyral resin ("Eslec BLS" (trade name), mfd. by Sekisui Kagaku K.K.) and 100 parts of cyclohexanone, were subjected to dispersion for 20 hours in a sand mill containing 1 mm-dia. glass beads. The resultant dispersion was diluted with 100 parts of methyl ethyl ketone to form a dispersion liquid for charge generation layer, which was then applied by dipping onto the above-formed undercoating layer to form 0.2 μm-thick charge generation layer.

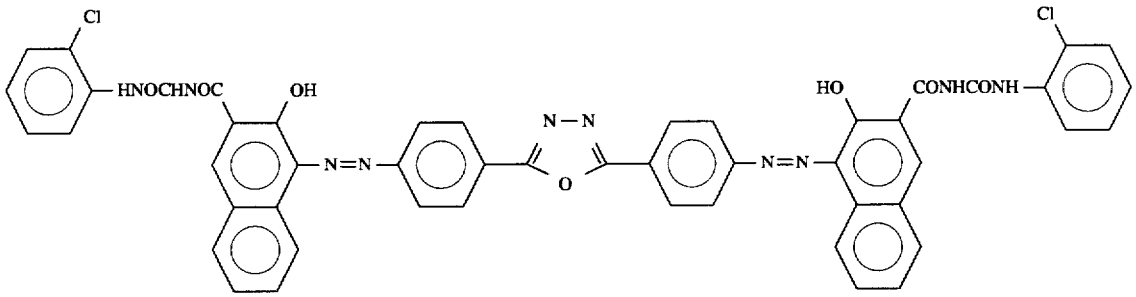

Then, 10 parts of Compound Example (3) as charge-transporting substance described hereinbefore and 10 parts of a bisphenol Z-type polycarbonate resin of the following formula having a viscosity-average molecular weight of 40,000 were dissolved in a solvent mixture of 50 parts of monochlorobenzene and 10 parts of dichloromethane to form a paint, which was then applied by dipping onto the above-formed charge generation layer to form a 20 μm-thick charge transport layer, thus preparing an electrophotographic photosensitive member.

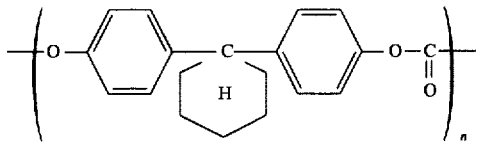

A commercially available electrophotographic image-forming apparatus ("NP-3525", mfd. by Canon K.K.) was remodeled by replacing the photosensitive member with the above-prepared electrophotographic photosensitive member, disposing a roller-shaped contact charging member in contact with the photosensitive member and replacing the silicone rubber-made cleaning blade with a urethane rubber-made cleaning blade. The contact charging member was prepared by coating the periphery of a stainless steel-made cylindrical bar having a diameter of 5 mm and a length of 350 mm with an electroconductive urethane rubber in a thickness of 7.5 mm and a width of 330 mm. The electroconductive urethane rubber was prepared by dispersing 4 parts of electroconductive carbon in 100 parts of urethane rubber. The charging member showed a volume resistivity of $10^6$ ohm.cm.

The above-remodeled electrophotographic apparatus was subjected to a durability test of successively copying on 5000 sheets of recording paper in an environment of a temperature of 35° C. and a relative humidity (RH) of 70%. In the durability test, the charging member was supplied with −1500 volts DC, the copying sheets were supplied at a rate of 200 mm/sec., and the performances of the apparatus were evaluated by the number of recording sheets after which 10 or more black spots other than the normal image occurred on a recording sheet due to toner sticking onto the photosensitive member during the durability test and the abrasion amount (reduced thickness) of the photosensitive member after the durability test. The results of the evaluation are shown in Table 1 appearing hereinafter.

Example 2

An electrophotographic photosensitive member was prepared in the same manner as in Example 1 except that the bisphenol Z-type polycarbonate resin was replaced by a bisphenol Z-type polycarbonate resin of the same structure but having a viscosity-average molecular weight of 32,000.

The electrophotographic photosensitive member thus produced was evaluated otherwise in the same manner as in Example 1. The results of the evaluation are also shown in Table 1.

Example 3

An electrophotographic photosensitive member was prepared in the same manner as in Example 1 except that the bisphenol Z-type polycarbonate resin was replaced by a bisphenol Z-type polycarbonate resin of the same structure but having a viscosity-average molecular weight of 48,000.

The electrophotographic photosensitive member thus produced was evaluated otherwise in the same manner as in Example 1. The results of the evaluation are also shown in Table 1.

Example 4

An electrophotographic photosensitive member was prepared in the same manner as in Example 1 except that the bisphenol Z-type polycarbonate resin was replaced by a mixture of a bisphenol Z-type polycarbonate resin of the following structural formula (A) having a viscosity-average molecular weight of 80,000 and polydimethylsiloxane of the following formula (B) having a viscosity-average molecular weight of 80,000.

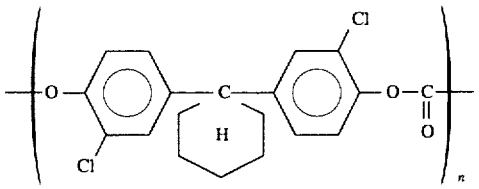

(A)

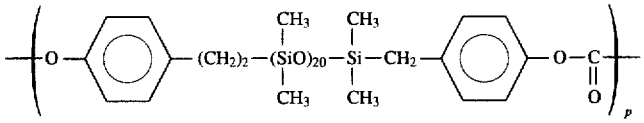

(B)

The electrophotographic photosensitive member thus produced was evaluated otherwise in the same manner as in Example 1. The results of the evaluation are also shown in Table 1.

Example 5

An electrophotographic photosensitive member was prepared in the same manner as in Example 1 except that the bisphenol Z-type polycarbonate resin was replaced by a bisphenol Z-type polycarbonate resin of the same structure but having a viscosity-average molecular weight of 90,000.

The electrophotographic photosensitive member thus produced was evaluated otherwise in the same manner as in Example 1. The results of the evaluation are also shown in Table 1.

Example 6

An electrophotographic photosensitive member was prepared in the same manner as in Example 1 except that the bisphenol Z-type polycarbonate resin was replaced by a bisphenol Z-type polycarbonate resin of the same structure but having a viscosity-average molecular weight of 22,000.

The electrophotographic photosensitive member thus produced was evaluated otherwise in the same manner as in Example 1. The results of the evaluation are also shown in Table 1.

Example 7

An electrophotographic photosensitive member was prepared in the same manner as in Example 1 except that the bisphenol Z-type polycarbonate resin having a viscosity-average molecular weight of 20,000. The photosensitive member was further coated by dipping with a 3 μm-thick protective layer comprising the bisphenol Z-type polycarbonate resin having a viscosity-average molecular weight of 32,000 used in Example 2 and Compound Example (3) as charge-transporting substance used in Example 1 in a weight ratio of 2:1.

The electrophotographic photosensitive member thus produced was evaluated otherwise in the same manner as in Example 1. The results of the evaluation are also show in Table 1.

Example 8

An electrophotographic photosensitive member was prepared in the same manner as in Example 7 except that the binder resin for constituting the protective layer was replaced by a 9:1 (by weight) mixture of the bisphenol Z-type polycarbonate resin having a viscosity-average molecular weight of 32,000 and the polydimethylsiloxane bisphenol used in Example 4.

The electrophotographic photosensitive member thus produced was evaluated otherwise in the same manner as in Example 1. The results of the evaluation are also show in Table 1.

Comparative Example 1

An electrophotographic photosensitive member was prepared in the same manner as in Example 1 except that the bisphenol Z-type polycarbonate resin was replaced by bisphenol A-type polycarbonate resin having a viscosity-average molecular weight of 20,000.

The electrophotographic photosensitive member thus produced was evaluated otherwise in the same manner as in Example 1. The results of the evaluation are also shown in Table 1.

TABLE 1

| | Number of sheets until occurrence of black spots (× 1000) | Abrasion amount (μm) |
|---|---|---|
| Example 1 | no black spots | 0.8 |
| 2 | 4.1 | 1.0 |
| 3 | 3.8 | 0.5 |
| 4 | 3.1 | 0.7 |
| 5 | 4.9 | 2.8 |
| 6 | 3.5 | 3.9 |
| 7 | 2.8 | 0.3 |
| 8 | 3.0 | 0.3 |
| Comp. Ex. 1 | 0.8 | 7,1 |

What is claimed is:

1. An electrophotographic image forming method, comprising:

a contact charging step for charging an electrophotographic photosensitive member having a surface layer comprising a bisphenol Z-type polycarbonate resin having a viscosity-average molecular weight of 30,000 to 80,000 by contact charging;

an imagewise exposure step for subjecting the charged electrophotographic photosensitive member to imagewise exposure to form an electrostatic latent image on the photosensitive member, and a development step for developing the electrostatic latent image on the electrophotographic photosensitive member.

2. An image forming method according to claim 1, wherein said bisphenol Z-type polycarbonate resin has a viscosity-average molecular weight of 30,000–60,000.

3. An image forming method according to claim 1, wherein said electrophotographic photosensitive member has a lamination-type photosensitive layer including a charge generation layer and a charge transport layer as said surface layer of the photosensitive member.

4. An image forming method according to claim 1, wherein said electrophotographic photosensitive member has a protective layer as the surface layer.

5. An electrophotographic apparatus, comprising:

an electrophotographic photosensitive member having a surface layer comprising a bisphenol Z-type polycarbonate resin having a viscosity-average molecular weight of 30,000 to 80,000, a charging member for charging the electrophotographic photosensitive member in contact with the electrophotographic photosensitive member, imagewise exposure means for imagewise exposing the charged electrophotographic photosensitive member to form an electrostatic latent image thereon, and developing means for developing the electrostatic latent image on the electrophotographic photosensitive member.

6. An apparatus according to claim 5, wherein said bisphenol Z-type polycarbonate resin has a viscosity-average molecular weight of 30,000–60,000.

7. An apparatus according to claim 5, wherein said electrophotographic photosensitive member has a lamination-type photosensitive layer including a charge generation layer and a charge transport layer as said surface layer of the photosensitive member.

8. An apparatus according to claim 5, wherein said electrophotographic photosensitive member has a protective layers as the surface layer.

9. An electrophotographic device unit, comprising:

an electrophotographic photosensitive member having a surface layer comprising a bisphenol Z-type polycarbonate resin having a viscosity-average molecular weight of 30,000 to 80.000, and a charging member for charging the electrophotographic photosensitive member in contact with the photosensitive member, the device unit being detachably mounted to a main assembly of an electrophotographic apparatus.

10. A device unit according to claim 9, further comprising developing means for developing an electrostatic image formed on the electrophotographic photosensitive member.

11. A device unit according to claim 9, wherein said bisphenol Z-type polycarbonate resin has a viscosity-average molecular weight of 30,000–60,000.

12. A device unit according to claim 9, wherein said electrophotographic photosensitive member has a lamination-type photosensitive layer including a charge generation layer and a charge transport layer as said surface layer of the photosensitive member.

13. A device unit according to claim 9, wherein said electrophotographic photosensitive member has a protective layer as the surface layer.

* * * * *

UNITED STATES PATENT AND TRADEMARK OFFICE

CERTIFICATE OF CORRECTION

PATENT NO. : 5,538,826

DATED : July 23, 1996

INVENTOR(S) : HIDEYUKI AINOYA ET AL.

It is certified that error appears in the above-identified patent and that said Letters Patent is hereby corrected as shown below:

COLUMN 3

Line 40, "subjected" should read --is subjected--.
Line 53, "means 12" should read --means 7--.

COLUMN 4

Line 38, "weight-average" should read --viscosity-average--.
Line 56, "slat" should read --salt--.

COLUMN 7

Line 21, "layertype" should read --layer-type--.
Line 40, "acrylonitrilestyrene" should read --acrylonitrile-styrene--.
Line 46, "Poly-" should read --poly- --.

COLUMN 8

Line 27, "ethyleneacrylic" should read --ethylene-acrylic--.
Line 52, "particledispersed" should read --particle-dispersed--.

COLUMN 9

Line 19, "particledispersed" should read --particle-dispersed--.
Line 24, "particledispersed" should read --particle-dispersed--.

UNITED STATES PATENT AND TRADEMARK OFFICE

CERTIFICATE OF CORRECTION

PATENT NO. : 5,538,826

DATED : July 23, 1996

INVENTOR(S) : HIDEYUKI AINOYA ET AL.

It is certified that error appears in the above-identified patent and that said Letters Patent is hereby corrected as shown below:

COLUMN 10

Line 16, "heatcuring" should read --heat-curing--.

COLUMN 12

Line 67, "resin having" should read --resin was replaced by a bisphenol Z-type polycarbonate resin of the same structure but having--.

COLUMN 13

Line 10, "show" should read --shown--.
Line 24, "show" should read --shown--.
Table 1, "7,1" should read --7.1--.

Column 14, line 38, "layers" should read —layer —.

Signed and Sealed this

Tenth Day of December, 1996

Bruce Lehman

BRUCE LEHMAN

*Commissioner of Patents and Trademarks*

*Attest:*

*Attesting Officer*